United States Patent [19]

Brown et al.

[11] 4,308,660

[45] Jan. 5, 1982

[54] MULTIPLE WIRE INSERTION APPARATUS

[75] Inventors: Christopher K. Brown, Camp Hill; Keith Johnson, Jr., Manheim; Donald A. Wion, Harrisburg, all of Pa.

[73] Assignee: AMP Incorporated, Harrisburg, Pa.

[21] Appl. No.: 143,696

[22] Filed: Apr. 25, 1980

[51] Int. Cl.[3] ..... H01R 43/04; B21F 1/02

[52] U.S. Cl. ..... 29/749; 29/753; 29/759; 140/147

[58] Field of Search ..... 29/749, 750–753, 29/759, 760; 140/147

[56] References Cited

U.S. PATENT DOCUMENTS

| | | | |
|---|---|---|---|
| 3,817,127 | 6/1974 | Soeller | 81/9.51 |
| 3,871,072 | 3/1975 | Folk | 140/105 |
| 3,881,246 | 5/1975 | Folk | 140/147 |
| 3,891,013 | 6/1975 | Folk et al. | 140/147 |
| 4,043,017 | 8/1977 | Folk et al. | 29/749 |
| 4,125,137 | 11/1978 | Shatto, Jr. | 140/147 |

*Primary Examiner*—Carl E. Hall

*Attorney, Agent, or Firm*—F. Brice Faller

[57] ABSTRACT

Apparatus for deploying pre-split wires of a multi-conductor cable into a predetermined coplanar array comprises a guide plate with a recess therein and a lid which closes thereagainst. Side by side wires are pushed into a wire receiving opening of the recess and are gathered into a strait therein and splayed into channels which align the wires for termination to terminals at insertion stations where the channels open on the end of the plate. An insertion ram pushes the leading ends of the wires downward into the terminals while the guide plate pivots downward against the action of a spring. A wire catch is provided to prevent reverse movement of wires in the channels.

8 Claims, 14 Drawing Figures

MULTIPLE WIRE INSERTION APPARATUS

BACKGROUND OF THE INVENTION

This invention relates to an improved apparatus for terminating the leading ends of the wires in a multi-conductor cable to terminals in a fixed array, and particularly to an apparatus which deploys the wires in a predetermined coplanar relationship to align them for terminating.

U.S. Pat. No. 4,141,618 discloses an insulation-displacing type terminal for wires, but does not suggest any particular method for inserting wires into such a terminal. In practice, wires have been inserted into such terminals by hand-tools, often a screw driver. Such means have proven effective but time consuming where large numbers of terminals are involved, as in harness manufacturing.

The prior art discloses several examples of templates or guide plates being utilized to pre-position wires in a coplanar array for terminating, e.g. U.S. Pat. Nos. 3,881,246, 4,043,017, and 4,125,137. These and related patents cited therein generally utilize roller means to wipe the wires into channels to position the leading ends in a pre-determined array, and none are directed to terminating wires in terminals mounted on a printed circuit board.

SUMMARY OF THE INVENTION

The instant invention is directed to a novel means for directing the wires of a multi-conductor cable in a coplanar array to insertion stations where they are terminated. This is done by manually feeding the leading ends of the wires into a covered recess which gathers the wires into a strait then splays them into channels by sharp leading edges of spacers which separate the channels and guide the wires to insertion stations where a printed circuit board (hereinafter PCB) with terminals thereon awaits. Travel of the wires is limited by a stop behind the insertion stations, and the wires are inserted downward into the terminals by the downward movement of a pneumatic insertion ram.

It is an object of the instant invention to provide wire guide means which do not require roller means to position the wires in the guides. It is another object to provide stop means in the insertion apparatus so the leading ends of wires are positioned for termination merely by pushing the wires into the guide means. It is a further bject to provide a quick and efficient means of terminating wires to insulation displacing terminals mounted on a printed circuit board.

The foregoing and other objects of the invention are achieved in a preferred embodiment thereof which is shown in the accompanying drawings and described in detail below.

DESCRIPTION OF THE PREFERRED EMBODIMENT

Figure 1:
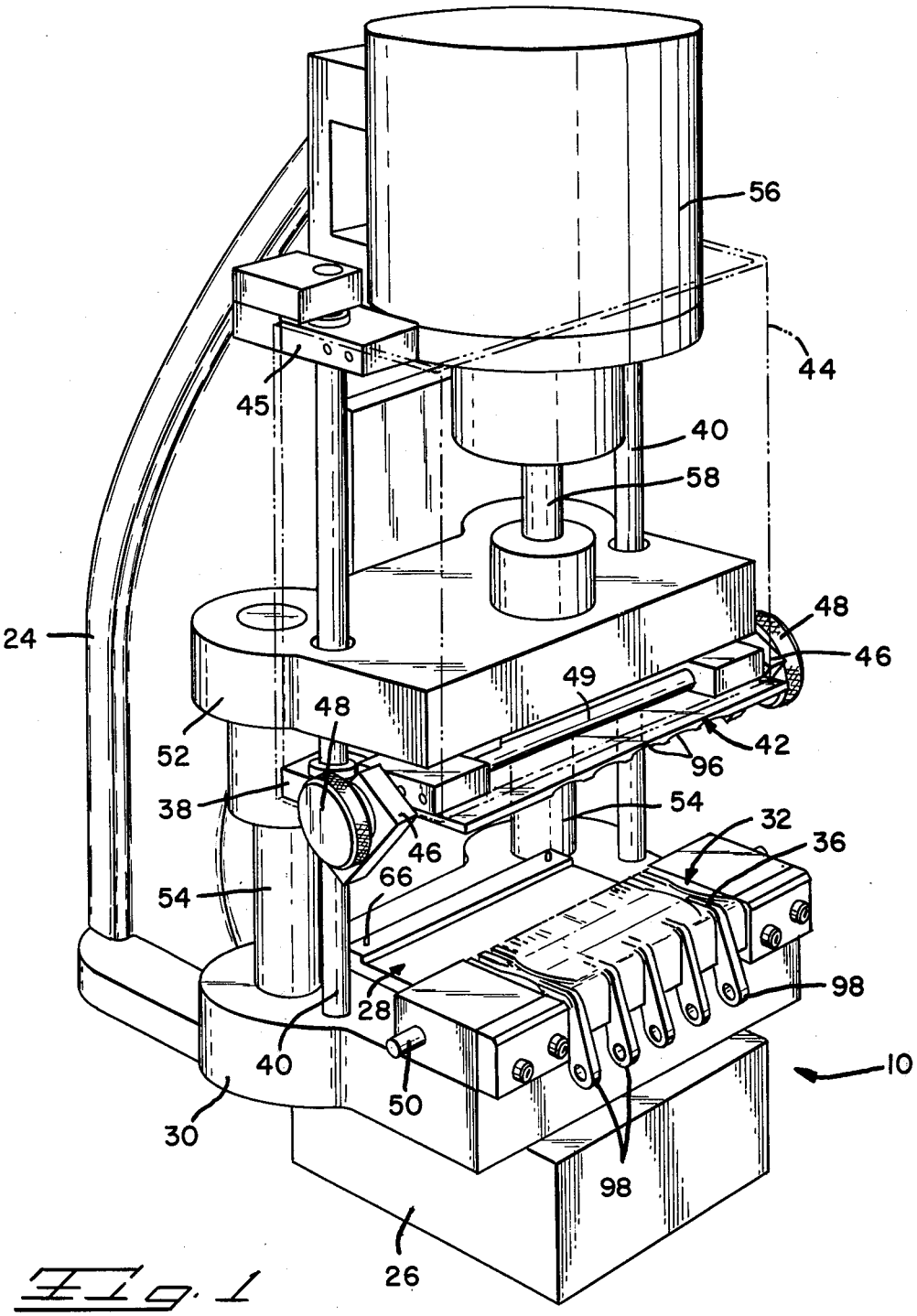
FIG. 1 is a perspective of the apparatus.
Figure 2A:
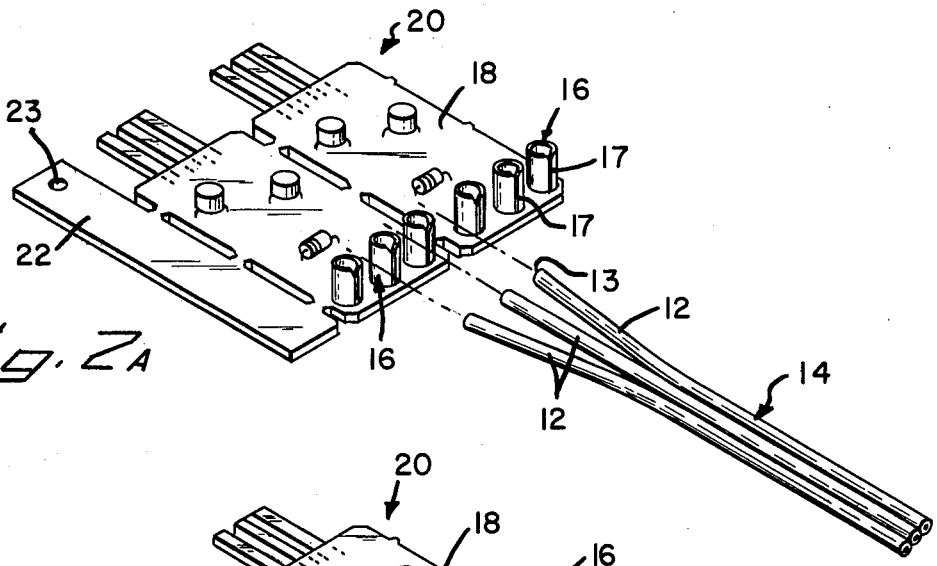
FIGS. 2A, 2B, and 2C are fragmentary perspectives of a block of PCB's and cable showing operational steps.
Figure 2B:
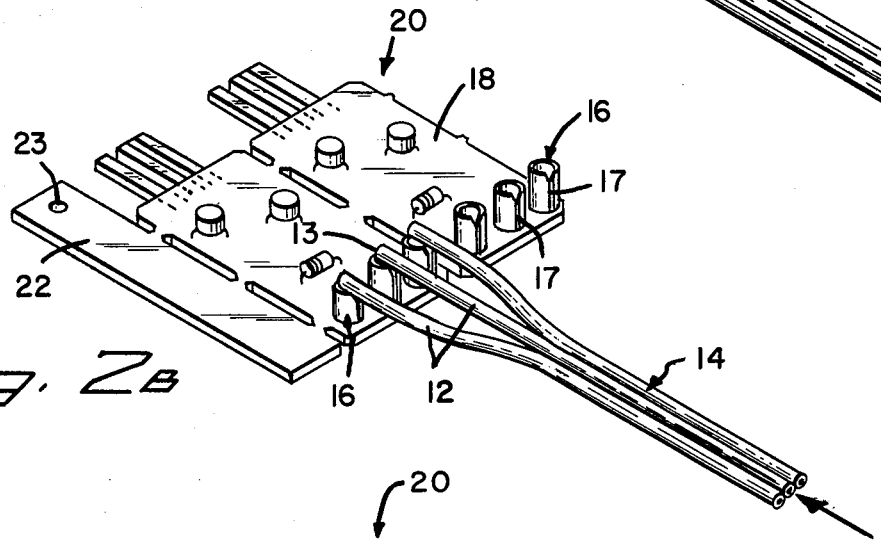
Figure 2C:
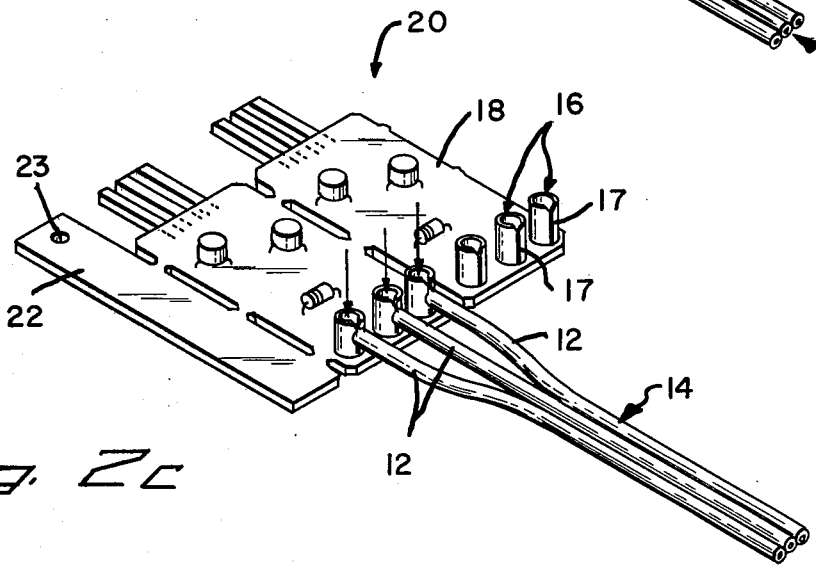

A multiple wire insertion apparatus 10, FIG. 1, is designed to guide the several wires 12 of a multi-conductor cable 14 to electrical terminals 16 and to insert the wires therein. The functions carried out by the apparatus 10 are depicted in FIGS. 2A, 2B, and 2C, which show a block 20 of printed circuit boards 18, hereinafter PCB's, each PCB 18 having a row of barrel terminals 16 mounted adjacent to one edge thereof. The PCB's 18 are identical and come in blocks 20 of five each, separably attached, between a pair of carrier strips 22 each having a hole 23 therein. Only two of the five PCB's and one of the carrier strips are shown. FIG. 2A shows a multiconductor cable 14 with the insulated wires 12 thereof cut and presplit. The insulation has not been stripped from the leading ends 13 of the wires since insulation displacing terminals are used. The preferred embodiment of apparatus 10 is directed to use with barrel terminals of the type disclosed in U.S. Pat. No. 4,141,618, the disclosure of which is incorporated herein by reference. The wires are fed into the apparatus until the leading ends 13 lie over the terminals as shown in FIG. 2B, then the leading ends are pressed into the terminals as shown in FIG. 2C.

Figure 3:
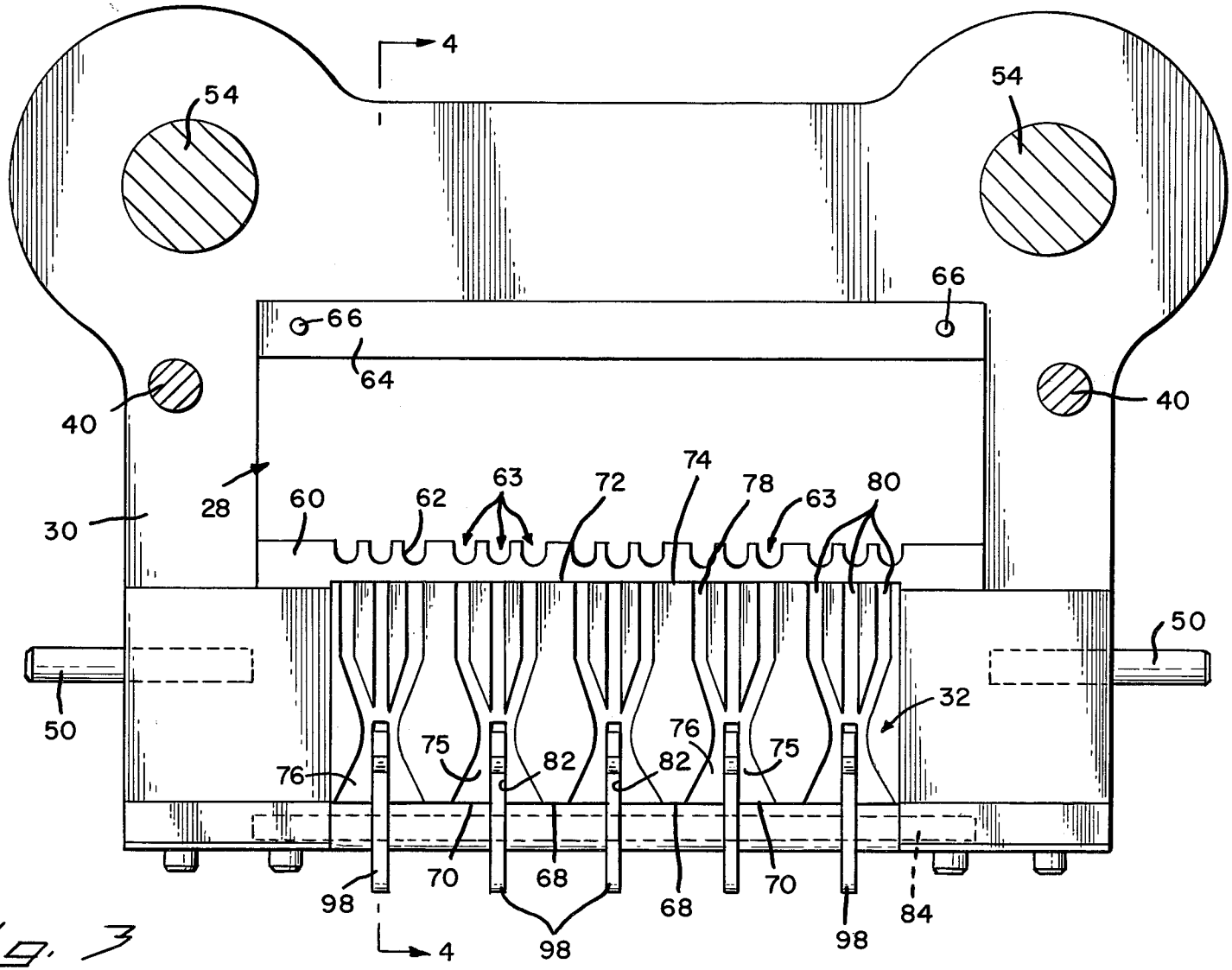
FIG. 3 is a plan view of the wire guide plate and platen prior to positioning PCB block.

Referring again to FIG. 1, the salient features of the apparatus 10 will be enumerated. A frame 24 is attached to a base 26 which has a mounting block 30 thereon. A platen 28 situated on the mounting block carries a guide plate 32 and wire catches 36 which are attached to catch handles 98. A lid carriage 38 rides vertically on guide shafts 40 and carries a lid 42, lid latches 46, and latch handles 48. The latches are connected by a latch shaft 49 and are designed to rotate and engage latch posts 50 when the lid is lowered. A guard 44 shown in phantom in this view for clarity attaches to the lid carriage at the bottom and a guard carriage 45 at the top; the guard carriage rides vertically on guide shafts 40 as a unit with the lid carriage 38. Insertion ram carriage 52 rides vertically on guide shafts 54 and is forced downward by piston 58 driven by pneumatic actuator 56. Referring now to FIG. 3, the platen 28 is profiled with a forward support ridge 60 having hollows 62 therein spaced to receive portions of the barrel terminals 16 which protrude below the circuit boards 18. The positions of the hollows and the space immediately above define the insertion stations 63. The rear edge of the platen is profiled with a rear support ridge 64 having posts 66 protruding therefrom which are positioned to mate with holes 23 in the carrier strips 22 of the PCB block 20. The PCB block may thus be fixedly located relative to the guide plate 32. The guide plate has a wire receiving end 68 having wire receiving openings 70 therein, a wire terminating end 72, and a top surface 74 therebetween. The guide plate is profiled by five recesses 75, each of which splits into three channels 78 intermediate the ends. The channels 78 terminate at ports 80 which open on the terminating end 72 of the guide plate 32. Each recess 75 has an opening 82 in the floor 76 thereof profiled to contain a wire catch 36 which protrudes slightly above the floor 76.

Figure 4:
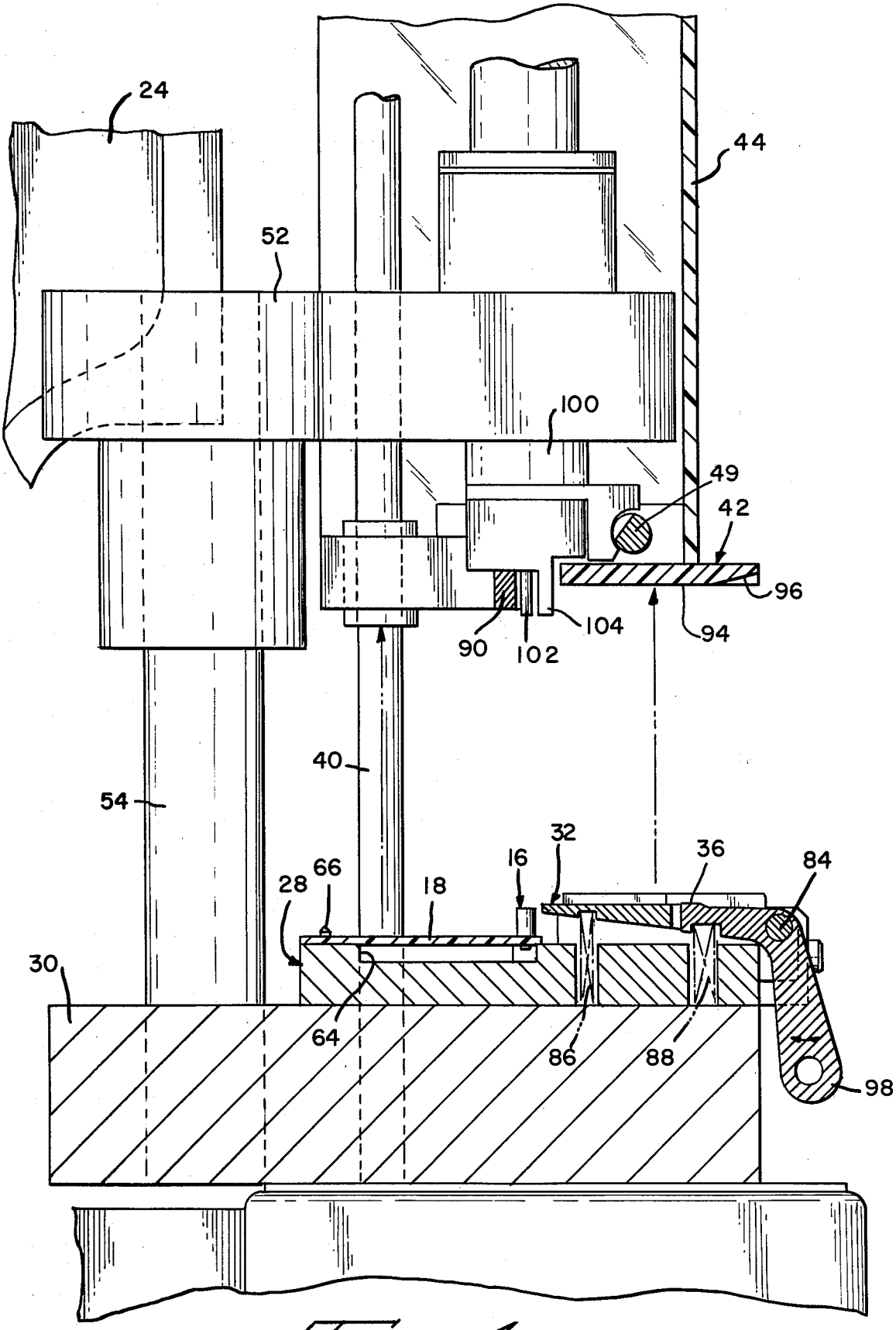
FIG. 4 is a cross-section after positioning PCB block, taken along 4—4 of FIG. 3.

The first step in the termination procedure is to insert a PCB block 20 into the apparatus 10 so that it is positioned on the support ridges 60, 64, as previously described. This presents the situation shown cross sectionally in FIG. 4. Here the details of the mounting arrangement of the guide plate 32 and wire catches 36 are apparent; both are mounted to the platen 28 on a common shaft 84 so that they can pivot downwardly against the action of springs 86, 88 as will be described later.

Figure 5:
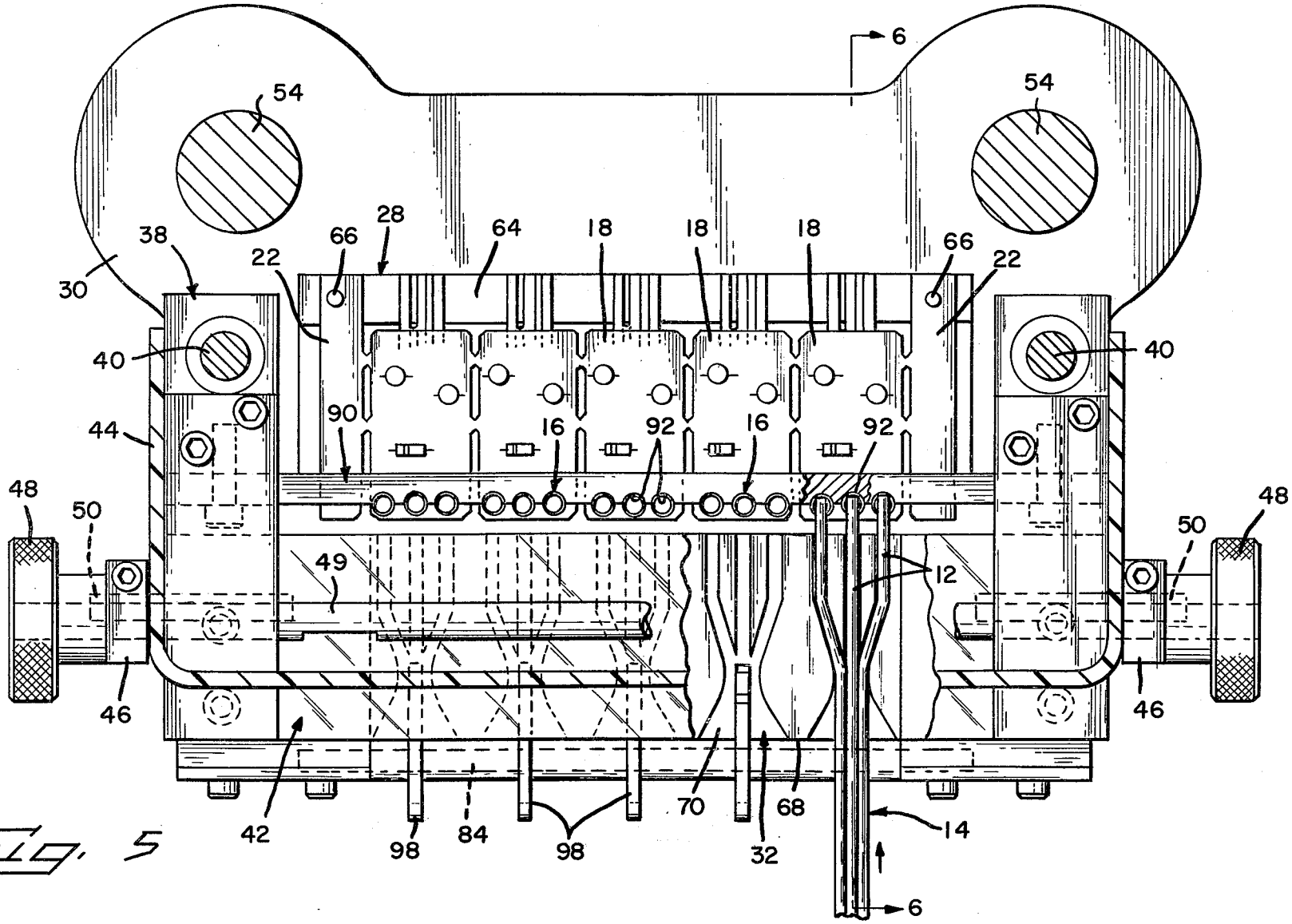
FIG. 5 is a plan view of the wire guide plate and platen after positioning PCB block and lowering lid carriage.
Figure 6:
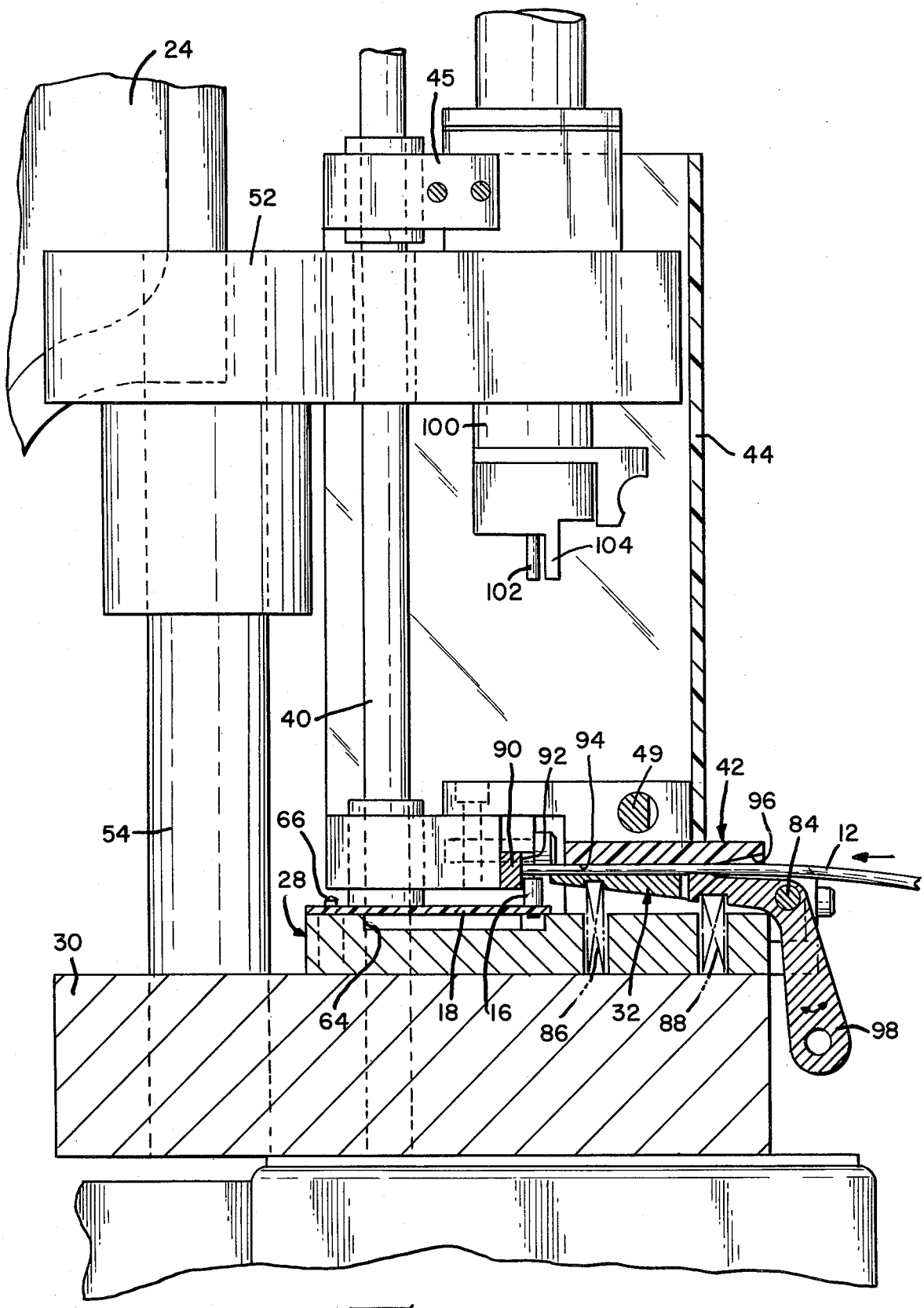
FIG. 6 is a cross-section taken along 6—6 of FIG. 5.
Figure 7:
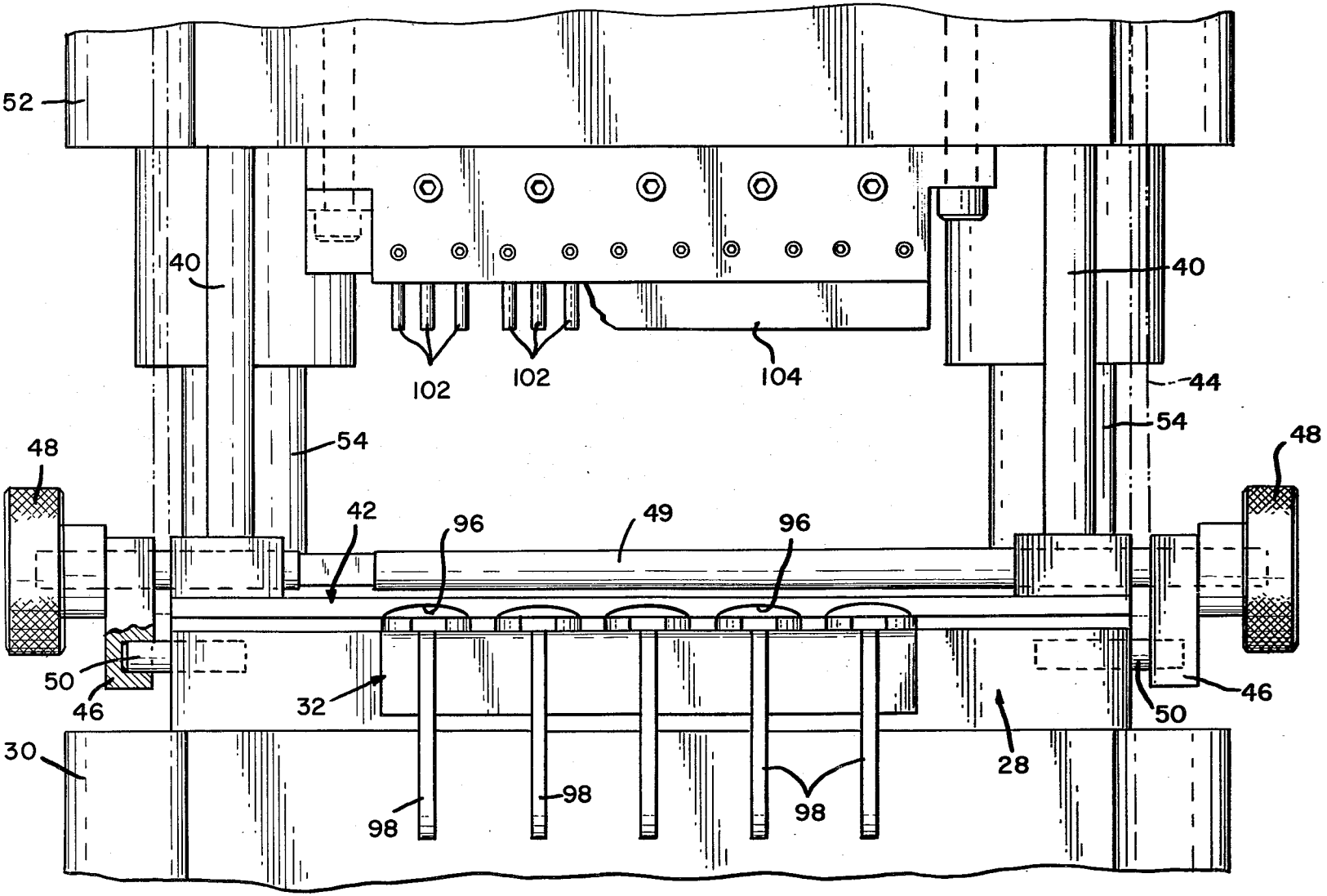
FIG. 7 is a front view of the apparatus after the lid carriage is lowered, with a cutaway view of the insertion ram carriage.

After the PCB block is positioned in the apparatus 10, the lid carriage 38 is lowered until the bottom surface 94 of the lid 42 lies against the top surface 74 of the guide plate 32. The latches 46 are now rotated by the latch handle 48 until the latches engage the latch posts 50 as previously described. This feature is shown best in FIG. 7, which is a front view of the apparatus at this stage of operation. The wires 12 are now inserted into the wire receiving opening 70 as shown in plan in FIG. 5 and cross-sectionally in FIG. 6. Insertion is facilitated by concavities 96 in the bottom surface 94 of the lid 42. The pre-split cable 14 is pushed into the recess until the leading ends 13 of the wires 12 lie over the barrel terminals 16. Here the wires are stopped by a wire stop 90 with arcuate notches 92 therein which lie adjacent the rear edge of the terminals 16; the stop 90 is affixed to the lid carriage 38. As the wires pass through the recess the leading ends are forced between the lid 42 and the wire catch 36 which pivots the catch into opening 82. The inclined surface of the catch which faces the wire receiving opening allows the wires to pass readily. The vertex of the inclined surface is urged against insulation of the wires by the action of catch return spring 88 to deter reverse movement. Should it be desired for any reason to withdraw the wires from the recess prior to termination, the catch handle 98 is moved counterclockwise from the position of FIG. 6 to compress spring 88 which removes the pressure from the wires so they can be withdrawn. Guard 44 appears cross-sectionally in FIGS. 5 and 6. Both the guard and the lid are made of clear plastic so that the operator can see what is happening to the wires. Once all five cables have been fully inserted, the wires are ready to be terminated.

Figure 8:
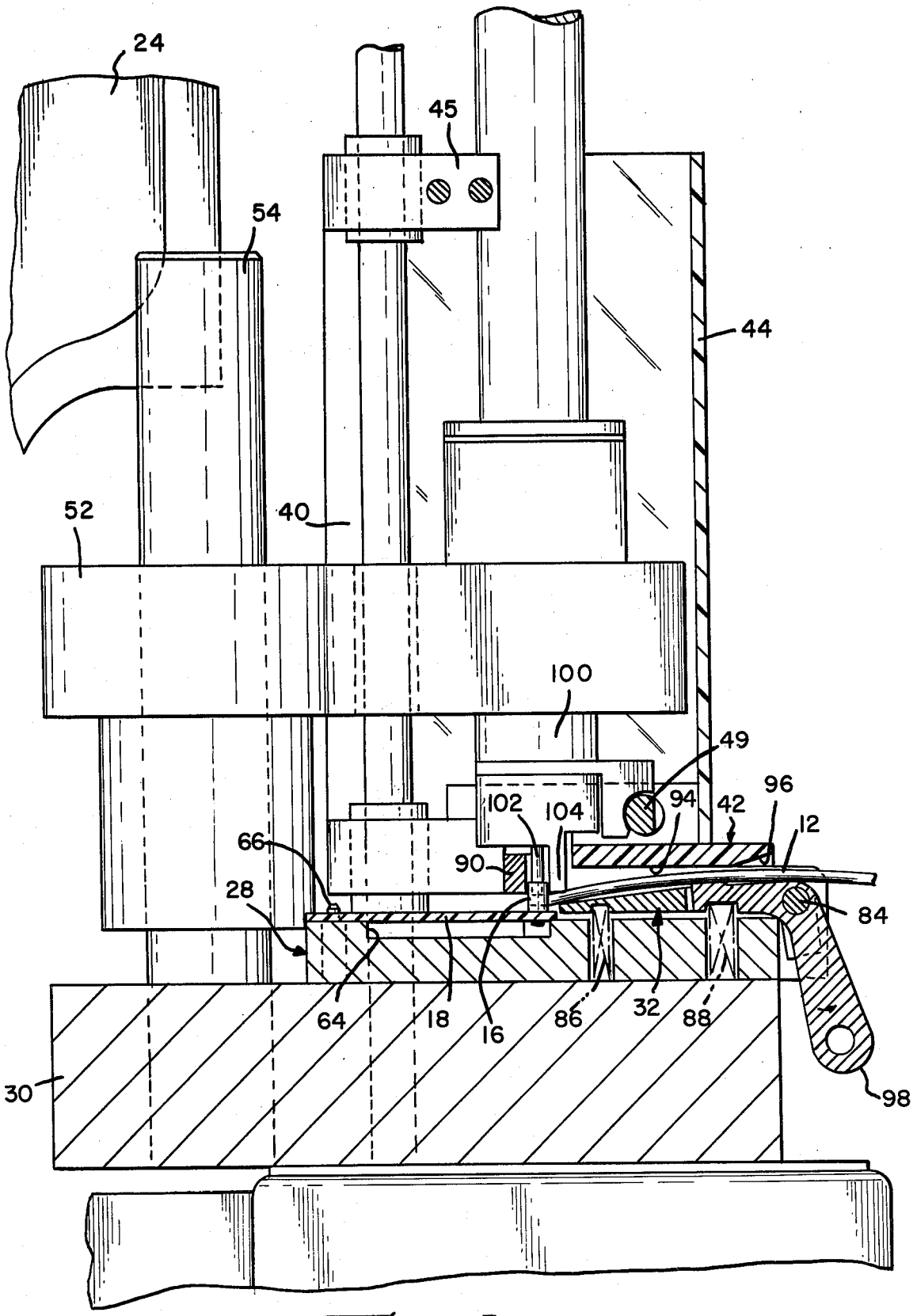
FIG. 8 is a cross-section similar to FIGS. 4 and 6, after the insertion ram drops and wires are terminated.

Termination is actuated by a remote switch such as a foot pedal which causes the pneumatic actuator 56 to force the insertion ram carriage 52 downward to insertion stations 63 by the action of piston 58. For safety purposes a switch (not shown) is provided which prevents the ram from dropping unless the guard is in place. The ram carriage 52 carries the insertion ram 100 which is comprised of insertion heads 102 and a curtain 104. These components are shown raised in FIGS. 6 and 7 and dropped in FIG. 8. The heads 102 are configured to bear on the wires and enter the barrel terminals 16 while the curtain drops in front of all the terminals and bears on the wires 12 between the terminals 16 and the ports 80 in the guide plate 32. Between the insertion heads 102 and the curtain 104, the wires are forced into the slots 17 in the terminals, displacing insulation to effect electrical contact. As the wires are forced downward by the action of the insertion ram, the terminating end 72 of the guide plate pivots downward about shaft 84 against the action of spring 86. After the wires are terminated, the ram 100 rises automatically and the guide plate returns to its original position. The latches 46 are then released, the lid 42 is raised, and the cable 14 and PCB block 20 are removed so that the operation may be repeated.

Figure 9:
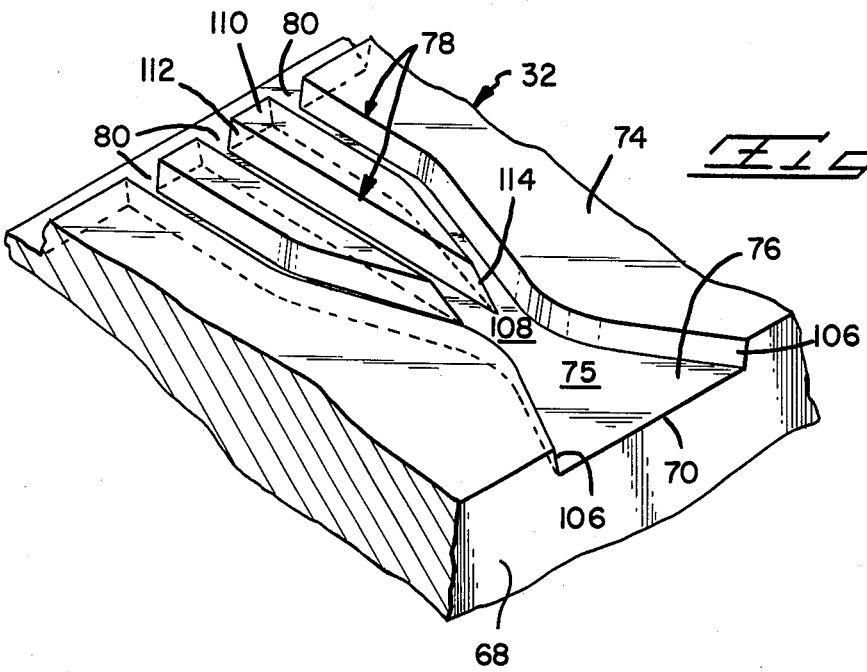
FIG. 9 is a simplified fragmentary perspective of the guide plate.
Figure 10:
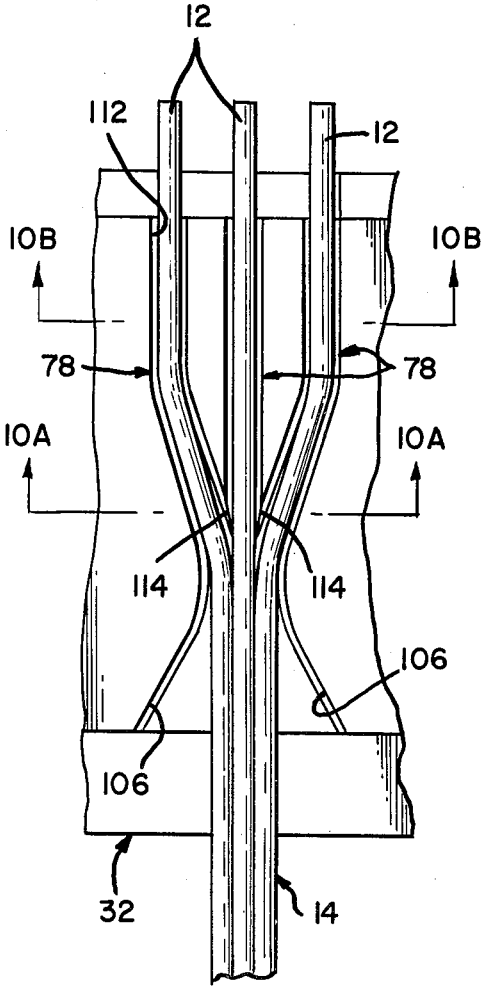
FIG. 10 is a fragmentary plan view of the guide plate with wires inserted.
Figure 10A:
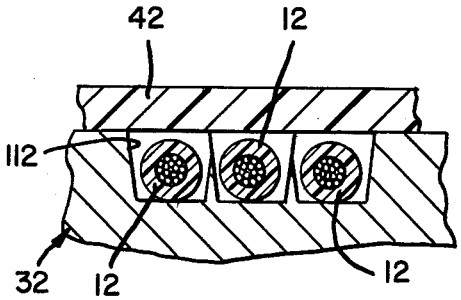
FIGS 10A and 10B are cross-sections of FIG. 10.
Figure 10B:
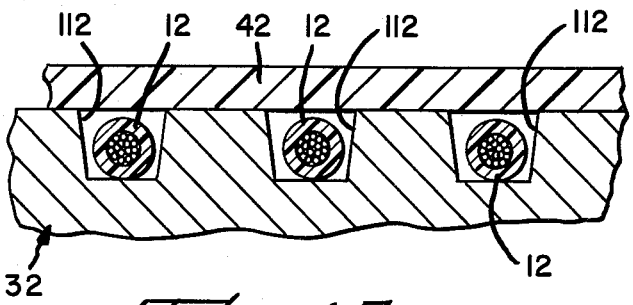

The design of the guide plate 32 and its operation will now be described in greater detail. A section of the plate 32 showing one recess 75 is shown perspectively in FIG. 9. The wire catch 36 and opening 82 have been omitted for clarity. The recess 75 have a planar floor 76 which parallels the top surface 74, and the recess is bounded by lateral walls 106. The floor 76 and the walls 106 define the wire receiving opening 70 at the wire receiving end 68 of the plate 32. The lateral walls 106 converge to form a strait 108 intermediate ends 68, 72; the strait acts to gather the wires and align them for splaying into channels 78 separated by spacers 110. The spacers 110 rise from the floor 76 to the plane of top surface 74; each spacer has opposed lateral surfaces 112 which meet at a sharp leading edge 114 and diverge gradually so that the channels 78 diverge gradually toward the terminating end of the guide plate. The divergence is gradual enough that the relative positions of the leading ends 13 of the wires relative the insertion stations will not vary appreciably despite the cable 14 having been cut such that the spread portions of the wires are of uniform length. These lateral surfaces 112 meet the floor at an obtuse angle and converge slightly between the floor and the plane of the top surface. In the preferred embodiment a seven degree angle with the vertical is used. This geometry gives the leading edge a slope between a point on the floor adjacent to the strait 108 and a point in the plane of the top surface remote from the strait. This slope in the leading edge 114 acts to separate and align the wires so that the leading ends 13 pass readily from strait 108 into the channels 78 on either side of the spacers 110. While generally the wire size is only slightly less than the width and depth of the channels, the strait being about three times the width of a channel in this embodiment, this design of the lateral surfaces permits some latitude in wire size since jamming of leading ends 13 against the leading edges 114 of the spacers is not a concern. The relation of the wires 12 to the recess 75 is shown in FIGS. 10, 10A, and 10B.

While the foregoing description is directed to but one embodiment of the subject invention, additional modifications within its scope will be apparent to one skilled in the art. For example, different terminals could be used by modifying the insertion ram, and other features could be modified so that wires could be terminated to terminals in a connnector.

What is claimed is:

1. Apparatus for deploying and locating a plurality of wires in a predetermined coplanar relationship comprises:

a guide plate having a wire receiving end, an opposed terminating end, and a generally planar top surface lying therebetween, said top surface having a recess therein extending between said ends, said recess having a generally planar floor which generally parallels said top surface, said recess being bounded by lateral walls, said lateral walls and said floor defining a wire receiving opening at said wire-receiving end, said lateral walls converging to constrict said recess to a strait remote from said opening, said recess splitting into a plurality of channels between said strait and said terminating end, said channels being seperated by one or more spacers, each spacer rising above the floor of the recess to the plane of the top surface, each spacer having opposed lateral surfaces which meet at a sharp leading edge adjacent to said strait and diverge between said leading edge and said terminating end, said lateral walls also diverging between said strait and said terminating end, said channels being of generally the same cross section throughout their length and likewise diverging between said strait and said terminating end, said channels terminating at ports which open on said terminating end, a lid having a generally planar bottom surface arranged to close against said top surface of said guide plate to enclose said recess except at said wire receiving opening and said ports, whereby, upon closing said lid against said top surface and inserting a like plurality of side by side wires into said wire receiving opening and through said recess said wires will be gathered into said strait then splayed into said channels, the diameter of the wires being only slightly less than the depth of the recess and the width of the channels, said wires thus being delivered to the ports at a predetermined spacing.

2. Apparatus for guiding a plurality of wires to insertion stations where the wires are inserted into terminals comprises:

a guide plate having a wire-receiving end, an opposed terminating end, and a generally planar top surface lying therebetween, said top surface having a recess therein extending between said ends, said recess having a generally planar floor which generally parallels said top surface, said recess being bounded by lateral walls, said lateral walls and said floor defining a wire receiving opening at said wire-receiving end, said lateral walls converging to constrict said recess to a strait remote from said opening, said recess splitting into a plurality of channels between said strait and said terminating end, said channels being separated by one or more spacers, each spacer rising above the floor of the recess of the plane of the top surface, each spacer having opposed lateral surfaces which meet at a sharp leading edge adjacent to said strait and diverge between said leading edge and said terminating end, said lateral walls also diverging between said strait and said terminating end, said channels being of generally the same cross section throughout their length and likewise diverging between said strait and said terminating end, said channels terminating at ports which open on said terminating end, a lid having a generally planar bottom surface arranged to close against said top surface of said guide plate to enclose said recess except at said wire receiving opening and said ports, a like plurality of insertion stations adjacent to respective ports where terminals may be fixedly located adjacent to said ports, means for terminating wires to said terminals, whereby, a like plurality of side by side wires may be terminated to a like plurality of terminals by locating said terminals at said insertion stations, inserting said wires into said wire receiving opening and through said recess until said wires emerge from said ports and pass over said insertion stations, said wires having been gathered into said strait then splayed into said channels, and terminating said wires said terminals.

3. The apparatus of claim 2, wherein said terminals are located below the floor of recess, said terminals being designed for wire insertion from above, and said guide plate is mounted to said apparatus pivotably at said wire-receiving end, whereby the terminating end may pivot downwardly as the wires are inserted downwardly into the terminals.

4. The apparatus of claim 2 or claim 3 which further comprises stop means, said stop means being located behind said insertion after said terminals are in place, whereby, the leading ends of said wires will be stopped after emerging from said ports and passing over said insertion stations.

5. The apparatus of claim 2 which further comprises a pivoted catch protruding above the floor of said recess from an opening therein, said catch being arranged to pivot into said opening against the action of a spring when said wires are inserted into said wire receiving opening and past said catch, said catch being profiled to deter reverse movement of said wires.

6. The apparatus of claim 3 which further comprises a catch mounted to said apparatus pivotably along the same axis as the guide plate, said catch protruding above the floor of said recess from an opening therein, said catch being arranged to pivot into said opening against the action of a spring when said wires are inserted into said wire receiving opening and past said catch, said catch being profiled to prevent reverse movement of said one or more wires, whereby, said catch will pivot downwardly with said guide plate as said wires as inserted into the terminals.

7. The apparatus of claim 2 wherein said means for terminating wires comprises a ram with a like plurality of insertion heads thereon, said heads being arranged to come down over respective insertion stations, said heads being configured to terminate said wires said terminals.

8. The apparatus of claim 1 or claim 2 wherein said lateral surfaces of each said spacer meet the floor of the recess at an obtuse angle, said lateral surfaces converging slightly between said floor and the plane of the top surface, said sharp leading edge of said spacer also meeting said floor at an obtuse angle, said edge sloping from a point on the floor adjacent to said strait to a point in the plane of the top surface remote from said strait.

* * * * *